US009167881B2

(12) United States Patent
Mehta et al.

(10) Patent No.: US 9,167,881 B2
(45) Date of Patent: Oct. 27, 2015

(54) CONTAINER FOR STORING AND DISPLAYING A COSMETIC PRODUCT

(71) Applicant: Je Matadi, Inc., Stafford, TX (US)

(72) Inventors: Pershant Mehta, Stafford, TX (US); Leo Chieh-Hao Chen, Stafford, TX (US)

(73) Assignee: JE MATADI, Inc., Stafford, TX (US)

( * ) Notice: Subject to any disclaimer, the term of this patent is extended or adjusted under 35 U.S.C. 154(b) by 282 days.

(21) Appl. No.: 13/959,632

(22) Filed: Aug. 5, 2013

(65) Prior Publication Data

US 2015/0037083 A1 Feb. 5, 2015

(51) Int. Cl.
*A45D 34/04* (2006.01)

(52) U.S. Cl.
CPC ..... *A45D 34/045* (2013.01); *A45D 2200/052* (2013.01); *A45D 2200/053* (2013.01)

(58) Field of Classification Search
CPC ..... A45D 34/045; A45D 40/265; A45D 2200/05; A45D 2200/052; A45D 2200/053; B65D 25/16; B65D 25/18
USPC ..... 401/129; 220/23.9
See application file for complete search history.

(56) References Cited

U.S. PATENT DOCUMENTS

| | | | | |
|---|---|---|---|---|
| RE21,757 | E * | 4/1941 | Deakers | A45D 40/265 401/126 |
| 4,705,053 | A * | 11/1987 | Goncalves | A45D 40/268 132/218 |
| 4,886,387 | A * | 12/1989 | Goldberg et al. | A45D 40/267 132/320 |
| 6,270,273 | B1 * | 8/2001 | Ohba | A45D 34/047 401/122 |
| 7,159,734 | B1 * | 1/2007 | O'Brien | B65D 25/16 220/495.07 |
| 8,083,092 | B2 | 12/2011 | Hartstock | |
| 8,083,427 | B2 | 12/2011 | Maddy | |
| D651,515 | S | 1/2012 | Haile | |
| D651,521 | S | 1/2012 | Haile | |
| D656,824 | S | 4/2012 | Haile | |
| 2006/0102192 | A1 * | 5/2006 | Fischer et al. | A45D 33/18 132/317 |
| 2008/0011778 | A1 * | 1/2008 | Ronsin | A45D 34/02 222/94 |
| 2008/0223884 | A1 * | 9/2008 | Vestbom | A45D 33/025 222/547 |
| 2009/0067913 | A1 * | 3/2009 | Vintimiglia | A45D 40/267 401/129 |
| 2010/0307529 | A1 * | 12/2010 | Schwab | A45D 33/18 132/218 |
| 2011/0056866 | A1 * | 3/2011 | Thiebault | A45D 33/26 206/581 |
| 2011/0120907 | A1 | 5/2011 | Haile | |
| 2012/0039659 | A1 * | 2/2012 | Sanchez | A45D 34/04 401/122 |
| 2013/0112314 | A1 * | 5/2013 | Lee | A45D 34/04 141/23 |
| 2013/0343798 | A1 * | 12/2013 | Delage | A45D 40/0068 401/81 |
| 2014/0086662 | A1 * | 3/2014 | Arney | A45D 40/264 401/129 |
| 2014/0205358 | A1 * | 7/2014 | Pschirer | A45D 40/262 401/126 |
| 2015/0021331 | A1 * | 1/2015 | Hennemann | B05B 11/0045 220/495.05 |

* cited by examiner

*Primary Examiner* — David Walczak
*Assistant Examiner* — Bradley Oliver
(74) *Attorney, Agent, or Firm* — Andrew W. Chu; Craft Chu PLLC

(57) ABSTRACT

A container system includes a bottle body having an inner cavity and a threaded rim, an inner housing compatible with the inner cavity, a layer of a sample of contents placed between the inner cavity of the bottle body and the inner housing, a receptacle removeably placed within the inner housing and storing contents, and a lid to form a seal with the bottle body, when attached to the threaded rim. There can also be a brush attached to the lid to dispense the contents. The contents are protected from degradation due to environmental exposure, while the layer still displays features of the contents. The receptacle has a first portion and a second portion. The portions have different shapes, but are made integral into a single cavity. The single cavity resists settling of the contents and facilitates stirring of the contents for actual use.

20 Claims, 2 Drawing Sheets

CONTAINER FOR STORING AND DISPLAYING A COSMETIC PRODUCT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to display containers for cosmetic products. More particularly, the present invention relates to a bottle to display and store contents, which are sensitive to environmental exposure. Even more particularly, the present invention relates to a bottle to accurately display and safely store artificial gel nail compositions, which are sensitive to ultraviolet radiation.

2. Description of Related Art Including Information Disclosed Under 37 CFR 1.97 and 37 CFR 1.98.

Display containers are important for cosmetic products because visual appearance is usually a determining factor for a consumer, when deciding whether to purchase a particular cosmetic product. Packaging and containers show representations of the color, shine, and other visual effects for all types of cosmetic products, such as hair dye, eye shadow, lipstick, nail polish, and others. When color or another visual effect is a selection criteria for a product, the packaging and containers showing the color or visual effect should be as accurate as possible. For clear containers, such as bottles, the cosmetic product is directly visible through the container. The consumer can visually inspect the product itself.

The difficulty with some cosmetic products is that the chemical composition of the cosmetic product is sensitive to environmental exposure. A clear bottle allows a photo-sensitive cosmetic product to be oxidized or polymerized or bleached from ambient light. In another example, artificial gel nail compositions can be sensitive to ultraviolet light. Application of the gel nail composition requires curing by a certain range of ultraviolet light in the finishing process. Early exposure to broad ultraviolet radiation from the environment, while stored in a bottle, degrades the product before use by the consumer. The broad ultraviolet radiation from ambient light may include radiation within the range used to finally cure the composition.

Besides displaying the cosmetic product, a display container is also required to safely store the product in a useable condition. Compositions can settle or separate into layers of compounds. Fumes can be generated from the chemicals in the cosmetic products. The container may require shaking or stirring to prepare the product for use on the consumer. The proper seals and container shape can contribute to safely storing the product, properly maintaining the product in a useable condition, and extending the shelf life of the product.

Various patents have issued in the field of containers for cosmetics. United States Patent Publication No. 20110120907, published for Haile on May 26, 2011, describes transparent containers with a coating to reduce transmission of light through the container. The coating and the placement of the coating create a visual effect for the consumer, while protecting the contents from exposure. Design patents covering the ornamental features of these transparent containers were also issued as U.S. Pat. No. D656824 on Apr. 3, 2012, U.S. Pat. No. D651521 on Jan. 3, 2012, and U.S. Pat. No. D651515 on Jan. 3, 2012.

U.S. Pat. No. 8,083,427, issued to Maddy on Dec. 27, 2011, discloses a container with a colored insert. The color of the colored insert corresponds to the color of the actual cosmetic product. The type of cosmetic product is lipstick in this patent.

U.S. Pat. No. 8,083,092, issued to Hartstock on Dec. 27, 2011, describes another container for liquid cosmetics, such as mascara and lip gloss. The invention discloses a transparent container to allow the contents to be viewed directly.

It is an object of an embodiment of the present invention to provide a container to store and display a cosmetic product.

It is another object of an embodiment of the present invention to provide a container to store and display a cosmetic product, which is sensitive to environmental exposure.

It is still another object of an embodiment of the present invention to provide a container to store and display a cosmetic product, which is sensitive to ultraviolet radiation.

It is still another object of an embodiment of the present invention to provide a container to store and display an artificial gel nail composition, which is sensitive to ultraviolet light.

It is an object of an embodiment of the present invention to provide a container to display the contents of the container through the container directly.

It is an object of an embodiment of the present invention to provide a container to display a sample of contents of the container.

It is another object of an embodiment of the present invention to provide a container to display a sample of contents of the container, while protecting the actual contents from exposure.

It is an object of an embodiment of the present invention to provide a container to safely store a cosmetic product until use by the consumer.

It is another object of an embodiment of the present invention to provide a container, which resists settling the contents within the container.

It is another object of an embodiment of the present invention to provide a container for storing contents, which facilitates stirring of the contents.

These and other objects and advantages of the present invention will become apparent from a reading of the attached specification and appended claims.

SUMMARY OF THE INVENTION

Embodiments of the present invention include a container system for displaying contents of the container, while simultaneously protecting the contents from environmental exposure. In particular, the container system can be used to store and display artificial gel nail compositions, which are sensitive to ultraviolet radiation. The container system can include a bottle body having an inner cavity and a threaded rim. The bottle body is generally cylindrical and made of a transparent material such as glass. The inner cavity has a generally tubular shape with a closed end, such as a bullet shape or a short test tube. There is an inner housing or plunger cup removeably placed within the inner cavity. The inner housing has a shape compatible with the inner cavity, according to whatever shape of the inner cavity. The dimensions of the inner housing are smaller than dimensions of the inner cavity, so that the inner housing can fit inside the bottle body. In one embodiment, a layer of a sample of contents is placed between the inner housing and the inner cavity of the bottle body. Before placing the inner housing in the inner cavity, an amount of sample is loaded into the inner cavity. The pressure of the inner housing being fit into the inner cavity spreads the sample into a layer of the contents. The contents are visible through the bottle body to display aspects of the content to the end user.

There is also a receptacle or fill cup removeably placed within the inner housing. The receptacle fits inside the inner housing and forms a single cavity for storing contents. The receptacle is filled with the actual contents for the end user. In some embodiments, the receptacle includes a first portion and a second portion. The second can be larger in volume than the first portion and can have a different shape than the first portion. The difference in shapes and the connection of the portions creates the single cavity, which stores the contents and prevents settling of the contents. Viscous fluid, such as gel nail compositions, cannot be shaken for mixing. These fluids can only be stirred, and they should not settle. The shapes of the portions resist settling and facilitate stirring. In some embodiments, the first portion has a conical shape with a closed tip, and the second portion is generally cylindrical with a rounded trough ring on a first end.

The present invention can further include a lid means or cover and a brush. The lid means has internal threads for removeable attachment to a threaded rim of the bottle body. The lid means forms a seal with the bottle body, so that the contents in the receptacle are secured, when the lid means is attached to the threaded rim. The brush includes a stem with an anchor end attached to an underside of the lid means, and a plurality of bristles at a tip end of the stem. The stem extends down into the receptacle from the lid means, through the second portion, and into the first portion, when the bottle body and the lid means are in a closed configuration. The bristles can be used to dispense the contents from the container system for user application.

The method of storing and displaying contents with embodiments of the container system is also included as part of the present invention. The method includes placing the sample of contents in the inner cavity of the bottle body; inserting the inner housing into the inner cavity of the bottle body; forming the layer of the sample between the inner cavity of the bottle body and the inner housing; inserting the receptacle into the inner housing; filling the receptacle with the contents; and sealing the bottle body with the lid. The layer has a color corresponding to contents stored within the receptacle. The layer is a coating over the inner housing and within the inner cavity of the bottle body. The layer is visible through the bottle body so that the color of the layer is displayed. The color of the bottle body matches the color of the contents in the receptacle. The method can also include embodiments with a step of attaching a brush to the lid, so that the stem of the brush extends from the underside of the lid, through contents within the second portion of the receptacle and aligns with the first portion of the receptacle.

DETAILED DESCRIPTION OF THE DRAWINGS

Figure 1:
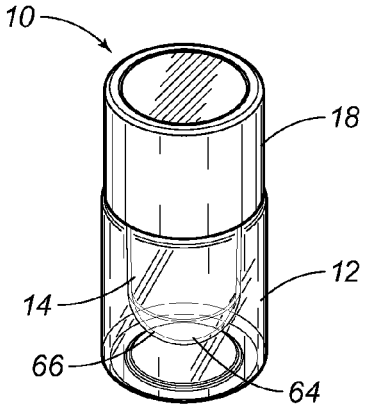
FIG. 1 is a perspective view of an embodiment of the container system of the present invention, showing a layer of a sample of contents through the bottle.
Figure 2:
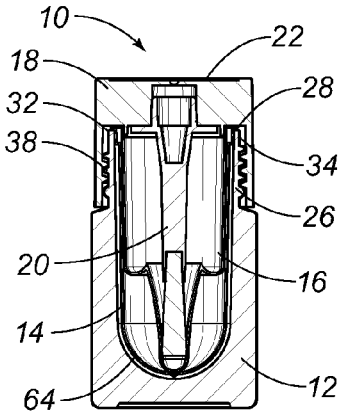
FIG. 2 is an exploded perspective view of another embodiment of the container system without the contents.
Figure 3:
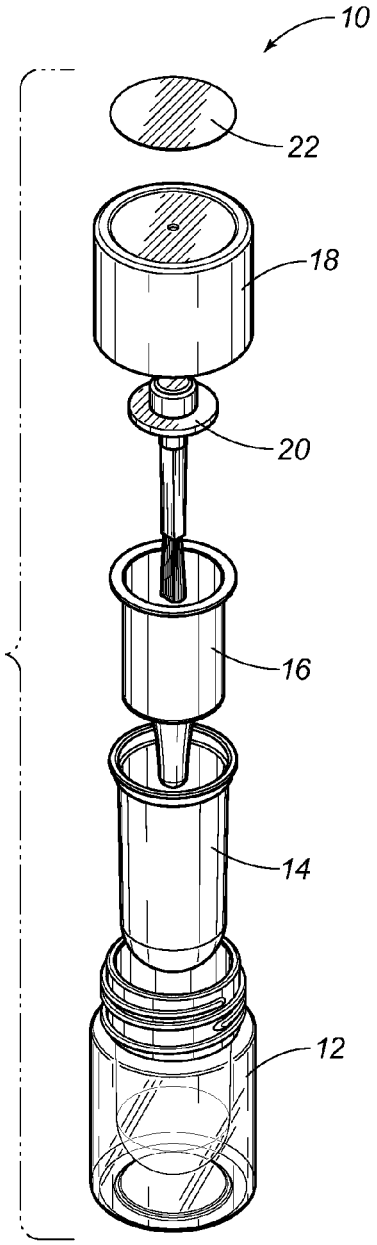
FIG. 3 is a cross-sectional view of the embodiment shown in FIG. 1.

Referring to FIGS. 1-3, embodiments of the present invention include a container system 10. The container system 10 stores and displays contents, such as a cosmetic product. More particularly, the cosmetic product is an artificial gel nail composition. The contents are sensitive to environmental exposure. For example, the artificial gel nail composition reacts to a range of ultraviolet radiation. A particular range of ultraviolet light is used to cure the composition during application on the nails of a consumer, and ambient light contains at least some of that range of ultraviolet radiation. Early exposure to that radiation, while in storage, degrades the composition so that actual use on the nail of user is affected. The container system 10 protects the contents from that exposure, while also displaying the contents through the container system 10 and maintaining the potency of the contents. FIGS. 1 and 3 show one embodiment of the container system 10 in a closed configuration with a layer 64 comprised of a sample 66 of contents visible through the bottle body 12. The contents sealed inside are the same as the contents of the sample 66. FIG. 2 shows an embodiment without the layer 64 for the parts of the embodiment of a container system 10 without any contents.

FIG. 2 shows the container system 10 having a bottle body 12, an inner housing 14, and a lid means 18 as viewed in the closed configuration. FIG. 2 shows the container system 10 having a bottle body 12, an inner housing 14, receptacle 16, a brush means 20, and a lid means 18. There is also a sticker 22 as a label for the container system 10. Similarly, FIG. 3 shows a cross-sectional view of the container system 10, according to the closed configuration of FIG. 1. FIGS. 1 and 3 disclose a container system 10 with the layer 64 to display to the consumer. FIGS. 1-3 show the interrelationship between the individual components of the container system 10. The closed configuration shows a sealed unit, wherein contents are stored within the receptacle 16 and sealed by the lid means 18 and the bottle body 12.

Figure 4:
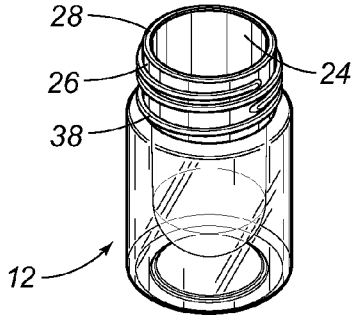
FIG. 4 is a perspective view of the bottle body of an embodiment of the present invention.
Figure 5:
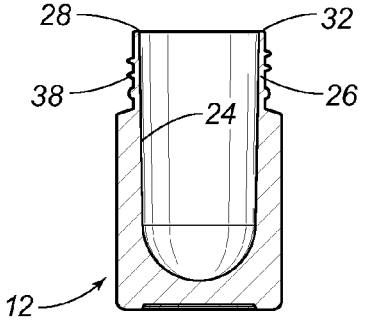
FIG. 5 is a cross-sectional view of the bottle body of FIG. 4.

FIGS. 4 and 5 are more detailed views of the bottle body 12. As shown, the bottle body 12 has a generally cylindrical shape, although a less than cylindrical shape is possible for ornamental purposes. The bottle body 12 can be made of glass in at least one embodiment of the invention. Other transparent materials, such as plastic, may also be possible, as long as the consumer can see through the material of the bottle body 12. Any vial shape or tubular shape for cosmetic products is within the scope of the bottle body 12 shape. FIG. 5 shows the bottle body 12 with an inner cavity 24 and a threaded rim 26. The inner cavity 24 has a generally tubular shape with a closed end, similar to a bullet shape or end of a test tube shape. There is a cavity rim 28 at an opening 30 of the inner cavity 24, which corresponds to the tip 32 of the threaded rim 26.

Figure 8:
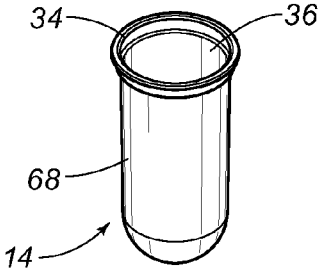
FIG. 8 is a perspective view of the inner housing of an embodiment of the present invention.
Figure 9:
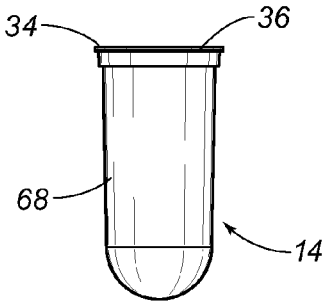
FIG. 9 is a cross-sectional view of the inner housing of FIG. 8.

FIGS. 8 and 9 show more detailed views of the inner housing 14 or plunger cup of the container system 10. The inner housing 14 has a shape compatible with the inner cavity 24 for display purposes. The inner housing 14 must also fit inside the inner cavity 24. Furthermore, the shape of the inner housing 14 should be compatible with placement within and removal from the inner cavity 24 because the inner housing 14 is removeably placed in the inner cavity 24. In at least one embodiment shown, the shape of the inner cavity 24 is generally tubular with a closed end, and the compatible shape of the inner housing 14 is also generally tubular with a closed end. FIGS. 1-3 show versions with the bullet shape for both the inner cavity 24 and the inner housing 14. The dimensions of the inner housing 16 are smaller than dimensions of the inner cavity 24 so that the shapes are compatible.

In embodiments of the present invention, the inner housing 14 can be comprised of a material generally impermeable to ultraviolet radiation. The inner housing 14 can protect contents within the bottle body 12 by being a protective barrier from light and other exposure. The inner housing 14 may or may not be transparent. The inner housing 14 may or may not be colored. The inner housing 14 may be adjusted to more accurate portray a visual appearance corresponding to the contents in the container system 10. Other embodiments include the inner housing 14 with a lipped rim 34 at an opening 36 of the inner housing 14. FIG. 3 shows the lipped rim 34 extending over the cavity rim 28 of the inner cavity 24. The lipped rim 34 is friction fit onto the cavity rim 28 and tip 32 of the threaded rim 26. FIG. 3 shows the lipped rim 34 wrapped over the bottle body 12. The lipped rim 34 remains clear of the threads 38 on the threaded rim 26.

Figure 10:
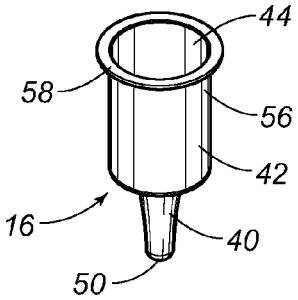
FIG. 10 is a perspective view of the receptacle of an embodiment of the present invention.
Figure 11:
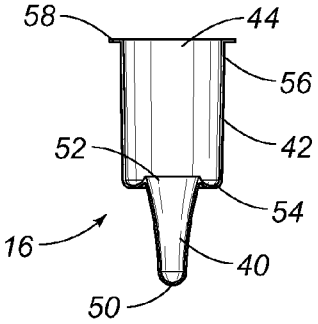
FIG. 11 is a cross-sectional view of the receptacle of FIG. 10.
Figure 12:
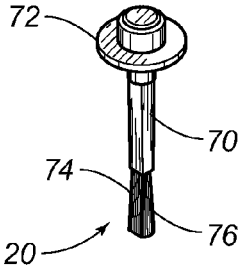
FIG. 12 is a perspective view of the brush of an embodiment of the present invention.

FIGS. 10 and 11 show more detailed views of the receptacle 16 or fill cup for at least one embodiment of the container system 10 of the present invention. The receptacle 16 is also removeably placed in the inner housing 14, so the receptacle 16 has a shape compatible with placement within and removal from the inner housing 14. FIGS. 2, 3, 10 and 11 show that the shape of the receptacle 16 is not directly analogous to the shape of the inner housing 14. The shape of the receptacle 16 is a consequence of storing contents efficiently to avoid settling, without a consideration for displaying contents. The shapes of the inner cavity 24 and inner housing 14 are based on displaying contents. The shape of the receptacle 16 must be compatible for removable placement, but not compatible for display purposes.

As seen in FIGS. 1-3, 10 and 11, the receptacle 16 is comprised of a first portion 40 and a second portion 42. The second portion 42 is larger in volume than the first portion 40, and the shapes are different. Even with different shapes, the first portion 40 and the second portion 42 are made integral to form a single cavity 44 for storing contents. In at least one embodiment, the first portion 40 is generally conical with a closed tip 50 and an opened end 52. The second portion 42 is generally cylindrical with a first end 54 made integral with the opened end 52 of the first portion and a second end 56 with a flanged rim 58.

The dual chamber of the single cavity 44 prevents settling of the contents during storage. Vertical walls hold a maximum amount of contents, but contents will slide down and settle, separating the contents into heavier and lighter components. In at least one embodiment of FIG. 11, the second portion 42 has vertical walls 46 and a troughed ring 48. The generally cylindrical shape of the vertical walls 46 holds a maximum amount of material, and the curvature of the troughed ring 48 resists settling of the contents. The contents can slide down the vertical walls 46 and fold back into itself corresponding to curvature of the troughed ring 48 and integral connection to the opened end 52 of the first portion 40. In some embodiments, the contents are viscous, such as artificial gel nail compositions. These viscous contents cannot be shaken, but rather the contents must be stirred. The first portion 40 has a cone shape with the closed tip 50, which can facilitate any stirring action through the contents. Additionally, the cone shape is not vertical, which changes the rate of settling of the contents as the contents slide down at a less than vertical angle.

FIGS. 3 and 11 also show the interaction of the flanged rim 58 and the seal on the bottle body 12. The flanged rim 58 fits over the lipped rim 36 of the inner housing 14. The flanged rim 58 remains clear of the threads 38 of the threaded rim 26.

Figure 6:
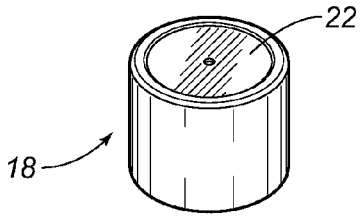
FIG. 6 is a perspective view of the lid means of an embodiment of the present invention.
Figure 7:
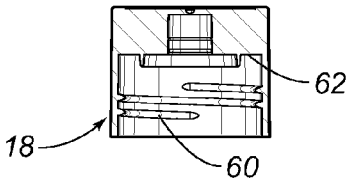
FIG. 7 is a cross-sectional view of the lid means of FIG. 6.

FIGS. 6 and 7 show more detailed views of an embodiment of the lid means 18 of the container system 10 of the present invention. The lid means 18 is clearly shown in FIGS. 1-3 as a cap to seal the bottle body 12. The lid means 18 has internal threads 60 on an attachment side 62. The internal thread 60 can be in screwing engagement with the threads 38 of the threaded rim 26 of the bottle body 12. The lid means 18 remains compatible with attachment to and separation from the threaded rim 26 of the bottle body 12. A seal is formed with the bottle body 12, when attached to the threaded rim 26. The attachment side 62 abuts the flanged rim 58, which seals against the lipped rim 36, which covers the cavity rim 28 of the bottle body 12. Contents remain sealed in the single cavity 44 of the receptacle 16. FIG. 2 shows an embodiment with a sticker label 22 attached to the lid means 18. The sticker label 22 attaches to a display side, opposite to the attachment side 62 facing the bottle body 12.

For displaying contents, at least one embodiment of the container system 10 of the present invention includes a layer 64 of a sample 66 of contents. The layer 64 is placed between the inner cavity 24 of the bottle body 12 and the inner housing 14. FIGS. 1 and 3 illustrate the layer 64 coating an outer surface 68 of the inner housing 14. The layer 64 can have a visual appearance corresponding to contents stored with the receptacle 16. Compatibility of shapes of the inner cavity 24 and the inner housing 14 allows for the layer 64 to fit between the inner cavity 24 and the inner housing 14 in an evenly distributed and smooth manner. The layer 64 remains visible through the bottle body 12, instead of the outer surface 68 of the inner housing 14. The color presented by the container system 10 is the color of the layer 64, which is the color of the contents, instead of the color of the inner housing. The container system 10 accurately displays the color of the contents for easy reference by the consumer. Additionally, the bottle body 12 is clear so that the layer 64 can be exposed to ultraviolet radiation. The cured or partially cured and hardened sample 66 is a more accurate visual presentation of the color of the contents to the consumer. The layer 64 can be applied during assembly of the container system 10.

Some embodiments of the container system 10 further include a brush means 20 within the bottle body 12. FIGS. 1-3 and 12 show this brush means 20 having a stem 70 with an anchor end 72 attached to an underside of the lid means 18, and a plurality of bristles 74 at a tip end 76 of the stem 70. The stem 70 can extend within the receptacle 16, through the second portion 42, and into the first portion 40. The closed tip 50 and conical shape of the first portion 40 are in alignment with the brush 20 in the closed configuration of FIGS. 1 and 3. The bristles 74 are housed within the closed tip 50 of the first portion 40. The brush means 20 can be the stirring means for the contents within the receptacle 16, as well as the applicator for the contents.

The present invention includes an embodiment of the method of storing and displaying contents, according to the container system 10. The method includes placing the sample 66 of contents in the inner cavity 24 of the bottle body 12, inserting the inner housing 14 into the inner cavity 24, forming the layer 64 of the sample 66 between the inner cavity 24 and the inner housing 14, inserting the receptacle 16 into the inner housing 14, filling the receptacle 16 with the contents, and sealing the bottle body 12 with the lid means 18. The sample 66 is a pre-determined amount of contents, based on the volume sufficient to fill space between the inner cavity 24 and the inner housing 14. The inner housing 14 is inserted into the inner cavity 24 until the lipped rim 36 engages the cavity rim 28 of the inner cavity 24, and the receptacle 16 is inserted into the inner housing 14 until the flanged rim 58 abuts the lipped rim 36.

Pressure of the inner housing 14 spreads the sample 66 over the inner housing 14 and within the inner cavity 24. The layer 64 coats the outer surface 68 of the inner housing 14, and the inner cavity 24 of the bottle body 12, as in FIGS. 1 and 3. The layer 64 remains visible through the bottle body 12, so that the layer 64 creates the visual presentation of the contents, instead of the contents themselves, including having a color corresponding to contents stored within the receptacle 16. With exposure through the bottle body 12, the layer 64 may also be hardened, when the contents are sensitive to ultraviolet radiation. The visible appearance now corresponds to the finished and hardened appearance of the contents.

For the step of sealing, the internal threads 60 of the lid means 18 are screwed onto the threaded rim 26 of the bottle body 12. The contents are sealed within the single cavity 44 of the receptacle 16 and an underside 62 of the lid means 18.

From FIGS. 1-3, the method can further comprise attaching a brush 20 to the lid means 18. The stem 70 extends through contents within the second portion 42 of the receptacle 16 and aligns with the first portion 40 of the receptacle 16. The bristles 76 are housed within the first portion 40 at the closed tip 50, when the bottle body 12 and the lid means 18 are in a closed configuration.

For embodiments of the present invention, the container system stores and displays a cosmetic product. The visual appearance created by the contents in the container system presents an accurate and realistic display of the contents, including color. When the cosmetic products are sensitive to environmental exposure, such as ultraviolet radiation, the present invention includes a receptacle placed within an inner housing for protecting contents stored within the receptacle. The inner housing reduces exposure, such as ultraviolet radiation. For artificial gel nails, the viscous composition is no longer cured or partially cured before application on a nail of the user.

The embodiments of the present invention also display the contents. The contents of the container system are shown through the container directly. There is no color insert or printing ink paint with accuracy issues because an actual sample of the contents is used to color the container system. A different bottle for a particular color is no longer required because a clear bottle can be filled with the contents and displayed in a separate layer. The sensitive contents can even be more accurately shown as the layer of the sample is at least partially cured and hardened by ambient light. Furthermore, the inner housing simultaneously shields the receptacle and contents from ultraviolet radiation and displays a color of the actual contents. No advanced color printing, labels, or individually painted bottles are needed with the present invention.

Embodiments also provide a container to safely store a cosmetic product until use by the consumer. The single cavity has a shape for increasing storage space and resisting settlement of the contents within the container. The troughed ring of the second portion and the conical shape of the first portion contribute to the resistance to settling of contents within the container. The conical shape also assists the stirring of the contents, keeping the contents viable for use by the consumer.

The foregoing disclosure and description of the invention is illustrative and explanatory thereof. Various changes in the details of the described method can be made without departing from the true spirit of the invention.

We claim:

1. A container system, comprising:

a bottle body being generally cylindrical and having an inner cavity and a threaded rim, said inner cavity having a generally tubular shape with a closed end and a cavity rim at an opening of said inner cavity, said cavity rim corresponding to said threaded rim of said bottle body;

an inner housing having a shape complementary to a shape of said inner cavity, said inner housing being compatible with placement within and removal from said inner cavity, said dimensions of said inner housing being smaller than dimensions of said inner cavity;

a receptacle being compatible with placement within and removal from said inner housing, said receptacle being comprised of a first portion and a second portion, said second portion being larger in volume than said first portion and having a different shape than said first portion, said first portion and said second portion being made integral to form a single cavity for storing contents; and a lid means having internal threads on an attachment side, said lid means being compatible with attachment to and separation from said threaded rim of said bottle body, said lid means forming a seal with said bottle body, when attached to said threaded rim.

2. The container system, according to claim 1, wherein said inner housing is comprised of a lipped rim at an opening of said inner housing, said lipped rim extending over said cavity rim of said inner cavity.

3. The container system, according to claim 1, wherein said first portion is generally conical with a closed tip and an opened end, and wherein said second portion is generally cylindrical with a first end made integral with said opened end of said first portion and a second end with a flanged rim.

4. The container system, according to claim 3, wherein said second portion is comprised of vertical walls and a troughed ring, said troughed ring being formed at said first end with said opened end of said first portion.

5. The container system, according to claim 3, wherein said flanged rim fits over said lipped rim of said inner housing.

6. The container system, according to claim 1, further comprising:

a layer of a sample of contents, said layer placed between said inner cavity of said bottle body and said inner housing, said layer coating an outer surface of said inner housing, said layer having a visual appearance corresponding to contents stored with said receptacle.

7. The container system, according to claim 1, further comprising:

a brush means comprised of a stem with an anchor end attached to an underside of said lid means, and a plurality of bristles at a tip end of said stem.

8. The container system, according to claim 7, wherein said stem extends within said receptacle, through said second portion, and into said first portion, when said bottle body and said lid means are in a closed configuration.

9. A method of storing and displaying contents in the container system of claim 1, said method comprising the steps of:

placing said sample of contents in said inner cavity of said bottle body, said sample being a pre-determined amount of contents;

inserting said inner housing into said inner cavity of said bottle body;

forming said layer of said sample between said inner cavity of said bottle body and said inner housing, wherein pressure of said inner housing spreads said sample over said inner housing and within said inner cavity;

inserting said receptacle into said inner housing, said flanged rim engaging said lipped rim;

filling said receptacle with said contents; and sealing said bottle body with said lid means, said internal threads of said lid means being in screwing attachment with said threaded rim of said bottle body, wherein contents are sealed within said single cavity of said receptacle and an underside of said lid means, and wherein said layer displays color corresponding to said contents.

10. The method of storing and displaying contents, according to claim 9, said step of forming said layer being comprised of coating an outer surface of said inner housing and an inner surface of said inner cavity of said bottle body.

11. The method of storing and displaying contents, according to claim 9, wherein said layer is visible through said bottle body.

12. The method of storing and displaying contents, according to claim 9, wherein said layer has a color corresponding to contents stored within said receptacle.

13. The method of storing and displaying contents, according to claim 9, further comprising the step of:

attaching a brush to said lid means, wherein said stem extends through contents within said second portion of said receptacle and aligns with said first portion of said receptacle, wherein said bristles are housed within said first portion, when said bottle body and said lid means are in a closed configuration.

14. A container system, comprising:

a bottle body being generally cylindrical and having an inner cavity and a threaded rim, said inner cavity having a generally tubular shape with a closed end and a cavity rim at an opening of said inner cavity, said cavity rim corresponding to said threaded rim of said bottle body;

an inner housing having a shape compatible with said inner cavity, said inner housing being compatible with placement within and removal from said inner cavity, said dimensions of said inner housing being smaller than dimensions of said inner cavity;

a layer of a sample of contents, said layer placed between said inner cavity of said bottle body and said inner housing, said layer coating an outer surface of said inner housing, said layer having a visual appearance corresponding to contents stored with said receptacle;

a receptacle being compatible with placement within and removal from said inner housing, said receptacle being comprised of a first portion and a second portion, said second portion being larger in volume than said first portion and having a different shape than said first portion, said first portion and said second portion being made integral to form a single cavity for storing contents; and a lid means having internal threads on an attachment side, said lid means being compatible with attachment to and separation from said threaded rim of said bottle body, said lid means forming a seal with said bottle body, when attached to said threaded rim.

15. The container system, according to claim 14, further comprising:

a brush means comprised of a stem with an anchor end attached to an underside of said lid means, and a plurality of bristles at a tip end of said stem.

16. The container system, according to claim 15, wherein said stem extends within said receptacle, through said second portion, and into said first portion, when said bottle body and said lid means are in a closed configuration.

17. The container system, according to claim 14, wherein said inner housing is comprised of a lipped rim at an opening of said inner housing, said lipped rim extending over said cavity rim of said inner cavity.

18. The container system, according to claim 14, wherein said first portion is generally conical with a closed tip and an opened end, and wherein said second portion is generally cylindrical with a first end made integral with said opened end of said first portion and a second end with a flanged rim.

19. The container system, according to claim 18, wherein said second portion is comprised of vertical walls and a troughed ring, said troughed ring being formed at said first end with said opened end of said first portion.

20. The container system, according to claim 18, wherein said flanged rim fits over said lipped rim of said inner housing.

* * * * *